US006857204B1

(12) United States Patent
Davis et al.

(10) Patent No.: US 6,857,204 B1
(45) Date of Patent: Feb. 22, 2005

(54) CLOSURE SYSTEM

(75) Inventors: Paul M. Davis, Blackstone, MA (US); William Marvin, Brighton, MA (US); Greg Reagan, Stonington, CT (US)

(73) Assignee: Reebok International Ltd., Canton, MA (US)

( * ) Notice: Subject to any disclaimer, the term of this patent is extended or adjusted under 35 U.S.C. 154(b) by 0 days.

(21) Appl. No.: 10/050,048

(22) Filed: Jan. 17, 2002

Related U.S. Application Data

(60) Provisional application No. 60/261,957, filed on Jan. 17, 2001.

(51) Int. Cl.[7] ..... A43C 11/00

(52) U.S. Cl. ..... 36/50.1; 36/45; 24/442

(58) Field of Search ..... 36/50.1, 45, 88, 36/136; 24/442

(56) References Cited

U.S. PATENT DOCUMENTS

| | | | | | |
|---|---|---|---|---|---|
| 770,535 | A | * | 9/1904 | Phillips | 36/50.1 |
| 4,079,527 | A | | 3/1978 | Antonius | |
| 4,114,297 | A | * | 9/1978 | Famolare, Jr. | 36/50.1 |
| 4,126,951 | A | | 11/1978 | Antonius | |
| 4,215,493 | A | | 8/1980 | Antonius | |
| 4,270,285 | A | | 6/1981 | Antonius | |
| 4,275,513 | A | | 6/1981 | Antonius | |
| 4,282,657 | A | | 8/1981 | Antonius | |
| 4,296,558 | A | | 10/1981 | Antonius | |
| 4,451,995 | A | | 6/1984 | Antonius | |
| 4,476,639 | A | * | 10/1984 | Zaccaria | 36/114 |
| 4,486,965 | A | * | 12/1984 | Friton | 36/50.1 |
| 4,599,811 | A | * | 7/1986 | Rousseau | 36/105 |
| 4,621,648 | A | * | 11/1986 | Ivany | 602/27 |
| 4,640,025 | A | * | 2/1987 | DeRenzo | 36/50.1 |
| RE32,585 | E | | 2/1988 | Antonius | |
| 4,751,784 | A | * | 6/1988 | Petker et al. | 36/9 R |
| 4,845,864 | A | * | 7/1989 | Corliss | 36/131 |
| 4,969,277 | A | * | 11/1990 | Williams | 36/97 |
| 5,014,448 | A | * | 5/1991 | Perrone | 36/110 |
| 5,015,251 | A | * | 5/1991 | Cherubini | 606/203 |
| 5,176,624 | A | * | 1/1993 | Kuehnreich | 602/65 |
| 5,699,629 | A | * | 12/1997 | Munschy | 36/97 |
| 5,744,080 | A | * | 4/1998 | Kennedy et al. | 264/167 |
| 5,797,862 | A | * | 8/1998 | Lamont | 602/10 |
| 6,212,798 | B1 | * | 4/2001 | Koenig et al. | 36/110 |
| 2003/0029057 | A1 | * | 2/2003 | Suzuki et al. | 36/50.1 |

* cited by examiner

*Primary Examiner*—M. D. Patterson
(74) *Attorney, Agent, or Firm*—Sterne, Kessler, Goldstein & Fox P.L.L.C.

(57) ABSTRACT

A closure system comprises a hook and pile material having hooks on one side and pile on the other side. With regard to footwear, the present invention is a shoe comprising this material allowing a wearer to adjust the point of attachment of closure straps on the exterior of the outer member of the shoe, thereby allowing every shoe wearer to wear the strap across the throat of the shoe at a different location. With regard to apparel, the present invention is a closure system comprising a single-ply hook and pile material in which the overlapped piece, or the exterior piece attaches to the underlapped piece, or the interior piece that provides the wearer with the ability to customize the fitting of the apparel, including the tightness of the apparel around an individual.

17 Claims, 5 Drawing Sheets

CLOSURE SYSTEM

CROSS-REFERENCE TO RELATED APPLICATIONS

This application is a non-provisional application of U.S. Provisional Application No. 60/261,957 filed on Jan. 17, 2001.

BACKGROUND OF THE INVENTION

1. Field of the Invention

This invention relates to an article of footwear and other apparel, especially for use in athletic activity. More specifically, the invention relates to a closure system for an article of footwear. The invention is a customized type closure system that allows the wearer to specifically tailor the fit of a shoe by adjusting the tautness and the attachment location of the closure system.

2. Background Art

Virtually all footwear and many types of apparel includes a closure system. Closure systems are used to tighten a shoe around a foot, hold the shoe in place on the foot, and can provide stabilizing support to the foot. Closure systems for footwear are as varied as the type of footwear that are currently available. For apparel, closure systems secure the flaps of a jacket, seal the cuffs of sleeves or pant legs, and draw any opening in the apparel around the body.

The most common type of closure system for footwear is a lacing system. In a conventional lacing system, a shoelace is strung between two sets of eyelets, one set on each side of a throat of a shoe. Although many lacing conventions are used to lace footwear, typically the shoelace extends from the bottom eyelet of set to the second most bottom eyelet of the opposite set. The lace extends through the second eyelet and extends toward the third most bottom eyelet of the original set, continuing back and forth until each eyelet of each set of eyelets has been laced. Pulling on the ends of the lace at the top of the eyelet sets will tighten the lace in all the eyelets, drawing the shoe snugly around the foot. Due to friction between the laces and the eyelets, and between the laces and the shoe structure, when a wearer pulls the lace taut, the lace is typically most taut at the end of the eyelets being drawn, and more loose as the laces extend toward the bottom eyelets.

As the shoes are worn, the tautness at the top end of the eyelet sets typically loosens due to the constant flexing of the foot or the minimal force exerted against the laces. Therefore, a wearer may be required to draw the laces too tight when tying the shoe. Unfortunately, the tighter that laces are drawn, the more likely that the laces will cause irritation to the top of the foot. Additionally, laces break, causing the wearer to experience discomfort and inconvenience. Thus, shoes using laces as a closure system require frequent retying in order to maintain a proper fit for the most comfort. Additionally, because the eyelets are in a fixed location, the lacing can not easily be tailored to a specific user, forcing every wearer, regardless of foot-shape or sensitivity, to have the laces cross the foot in the exact same place every time the shoe is worm. Thus, lacing tends to be uncomfortable and can be burdensome.

There have, of course, been many attempts to solve the inherent problems associated with conventional lacing systems. One solution proposed by Avia Group International (at the time a subsidiary of the assignee of the present invention) was to have a bilateral lacing system whereby the laces did not cross over the top of the foot. This invention is disclosed in U.S. Pat. No. 4,817,303 to Selbiger. This solution, while helping with the irritation caused by conventional lacing systems did not alleviate the need to have to tie the shoe. In addition, it did not address the need for a customized closure system.

With the advent of the hook and pile closure came shoes which utilized strapping as closure systems which did not require a shoelace. These closure systems were particularly useful in children's shoes because children could put on their shoes without the need for tying a shoelace. Although closure systems of this type were in some ways an improvement in terms of comfort, they suffered from some of the same problems as lacing systems. Particularly, systems using a hook and pile system typically use a strap which extends across the throat of a shoe. On the end of the strap, a piece of material is sewn which has either a pile material or a hook material. The strap extends across the throat of a shoe and either the pile or hook material on the strap attaches to another piece of material sewn onto the upper of the shoe which has the other of the pile or hook material. The material which has been sewn into the upper is a pile material if the strap has a hook material or a hook material if the strap has a pile material. These hook and pile materials are commercially available from a variety of sources. For example, these materials are sold under the trademark VELCRO.

A problem with shoes made using the above-described material is that the shoe closure system can still cause irritation and discomfort due to the multiple layers of material necessary to use and apply the hook and pile configuration. For instance, at the point of attachment of the strap to the upper, there is at least the upper material, the pile material, the hook material and the strap material. When stacked together, the attachment is bulky and unwieldy.

In addition, these systems do not adequately address the problem of customization of the closure system. A wearer can adjust the tightness of the shoe, but the strap can be connected to the upper only at the specific point at which the attaching material is sewn. Thus, a wearer cannot customize the closure system by adjusting the point of attachment, forcing every shoe wearer to wear the strap across the throat of the shoe at the same point, regardless of foot condition, shape or sensitivity.

The most common types of closure systems used in apparel other than footwear is zippers, buttons and snaps. Zippers allow sides of openings to be secured together. For instance, in a jacket, the opening typically extends up the center of the body from the jacket waist to the jacket neck. Zippers include teeth that must align properly in order for a zipper to properly function. Accordingly, the zipper is started at one end, and the teeth engage in order until they are all engaged.

Zippers allow no custom closing of the jacket flaps. One cannot draw a zipper more or less tight. The tightness of the jacket around an individual will be fixed by the location of the zipper. Although one may zip a zipper a desired distance, such as half-way, tightness of the jacket around a wearer's body cannot be adjusted.

Snaps and buttons are also often used as closure systems. Like zippers, snaps and buttons offer no customization of the closure system. Buttons or snaps, on one flap of a jacket for instance, must align properly with button-holes or corresponding snaps on the other flap of the jacket. Although a button can be inserted through any one button-hole, and snaps can be snapped to a non-aligned snap, buttons, button-holes and snaps do not allow for customization by drawing the apparel more or less tight around the wearer's body.

What is needed is a closure system for footwear that allows a wearer to adjust the location of the attachment of the strap across the throat and heel, so that a wearer can make personal, customized adjustments to the attachment location of the straps of the closure system while still providing sufficient support for the foot. Additionally, what is needed is a closure system for apparel that allows a wearer to make personal, customized adjustments to the closure system so the wearer may draw the apparel about the wearer's body to provide a customized fit. Additionally, what is needed is a closure system that uses the customization to provide maximum comfort, while still providing a simple and non-bulky closure system.

BRIEF SUMMARY OF THE INVENTION

The present invention is a new closure system for footwear and other articles of apparel. In footwear, the closure system comprises an outer member of a shoe upper. The outer member extends around the exterior of the shoe. The outer member is comprised of a hook and pile closure material and serves as a low profile, customizable closure mechanism. The closure system can be used on any shoe requiring a closure system, including athletic shoes, casual shoes, dress shoes, women's shoes and any type of boots.

The outer member comprises a material having hooks on one side and pile on the other side. Thus, overlapping any one side of the material over the other side will cause the two overlapping pieces to attach. The outer member includes vamp straps and may include heel straps. Accordingly, each of the straps include either hooks or pile material on the exterior or exposed surface of the straps, along with the entire outer member. Thus, the interior or non-exposed surface is comprised of the other of the hook or pile material. As the straps extend and overlap any portion of the exterior of the outer member, the hooks and the pile material of the interior of the straps and the exterior of the outer member will attach, with the hooks embedding in and attaching to the pile material.

The straps can be adjusted to a desired tautness to provide customized support and stability to the whole foot, including the heel and ankle region. The closure system allows a wearer to adjust the point of attachment, thereby allowing every shoe wearer to wear the strap across the vamp of the shoe at a different location, to customize the fit and conform to any desired foot condition or shape. Thus, the closure system is not area-specific, allowing a wearer to position and attach the closure straps where they are most comfortable for the individual wearer. Additionally, the closure system maintains a low profile, rendering the shoe more comfortable and its appearance more elegant.

With regard to apparel, the present invention is a closure system for jackets, shirts, pants, including pant waists, or cuffs of any item of apparel, including jackets, shirts and pants. The closure system provides a wearer with the ability to customize the fitting of the apparel, including the tightness of the apparel around an individual.

Substantially all of the outer surface of the apparel is comprised of a single-ply material having hooks on one side and pile on the other side. Thus, overlapping any one side of the material over the other side will cause the overlapped piece, or the exterior piece to attach to the underlapped piece, or the interior piece.

A plurality of straps, also comprised of single-ply hook and pile material extend across a slit to fasten the apparel closed. Because the interior surface of the straps contacts the exterior surface of the apparel, the hooks or pile depending on which is the interior surface, of the straps engage and fasten to the hooks or pile of the apparel.

The present invention can be used with closure system for a cuff of a jacket, shirt or pants. The cuff comprises a strap that is sewn or otherwise attached to sleeve, such as a jacket. The strap loops around the circumference of the cuff, and a first end extends through a slot formed into the strap near the second end. The strap of the cuff includes an exterior surface and an interior surface with hooks on one surface and pile on the other surface. As the interior surface of either end of the strap overlaps any portion of exterior surface of the strap, the hooks of the interior surface engage and attach to the pile on exterior surface of the strap.

BRIEF DESCRIPTION OF THE DRAWINGS/ FIGURES

The foregoing and other features and advantages of the invention will be apparent from the following, more particular description of a preferred embodiment of the invention, as illustrated in the accompanying drawings.

DETAILED DESCRIPTION OF THE INVENTION

The preferred embodiment of the present invention is now described with reference to the figures where like reference numbers indicate identical or functionally similar elements. While specific materials and method steps are discussed, it should be understood that this is done for illustrative purposes only. A person skilled in the relevant art will recognize that other materials or method steps can be used.

The present invention combines a hook and pile material with footwear to form a new upper and closure system. The closure system can be used on any shoe requiring a closure system, including athletic shoes, casual shoes, dress shoes, women's shoes and any type of boots. The closure system provides a wearer with the ability to customize the fitting of the shoe while eliminating a bulky multi-layered closure system.

Figure 1:
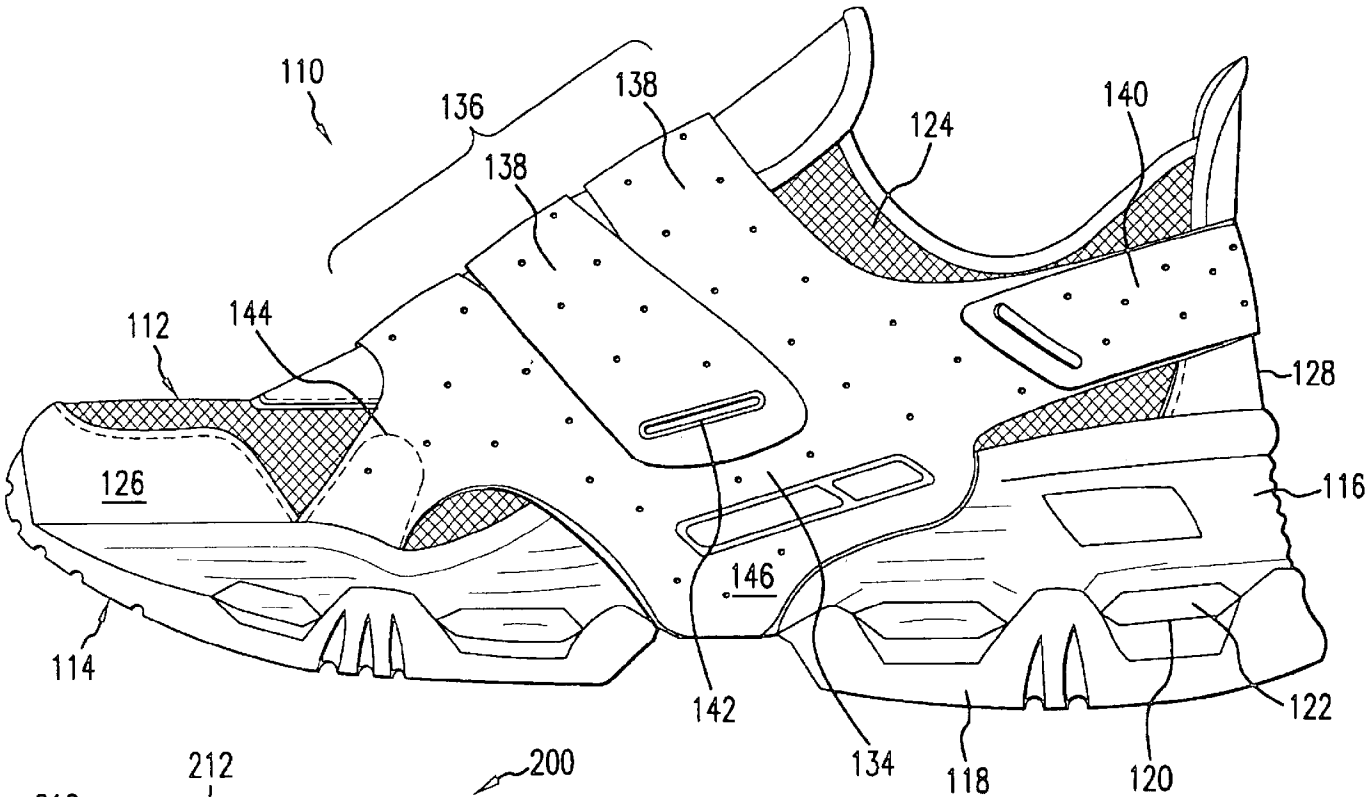
FIG. 1 is a shoe showing the closure system of the present invention.

FIG. 1 depicts a shoe 110 having an upper 112 and a sole 114. Although FIG. 1 depicts the medial side of a left shoe, it will be understood that the invention is equally applicable to the right shoe. Upper 112 is used to hold the foot of the wearer to sole 114, provide a tight and comfortable fit, and prevent sliding of the foot within the shoe. Upper 112 can be constructed in part of leather or other materials having properties similar to leather. Leather and other similar materials usually provide the necessary rigidity for supporting a foot in the shoe. Optionally, upper 112 can be constructed at least in part of various synthetic materials such as polymer meshes. Polymer meshes are light and breathable. Meshes can be advantageous in athletic shoes where a lightweight shoe is important to the athlete's performance during athletic activities, e.g., running and walking events. The mesh also allows the foot to breathe thereby keeping the foot relatively dry during athletic activities. Upper 112 could also be a hybrid-type upper constructed of a combination of the lightweight, more flexible, synthetic materials and stiffer materials such as leather straps and panels for reinforcement. As described herein below, upper 112 may be formed entirely from a material having hooks on one side of the material and a pile on the other side of the material. This material is commercially available from a variety of sources. A version of such a material is made and sold by Velcro USA, Inc. under the trademark "ONE-WRAP." In another embodiment of the current invention, the ONE-WRAP® material forms only a portion of upper 112.

Upper 112 is secured to sole 114 in any conventional manner, e.g., by gluing to the upper surface of sole 114. Sole 114 provides traction, support and cushioning. Sole 114 may have a midsole 116 to provide cushioning and an outsole 118. Midsole 116 provides cushioning and support and is more compressible than outsole 118. Midsole 116 is made of a cushioning material such as polyurethane (PU), ethyl vinyl acetate (EVA) or a polyester elastomer such as HYTREL® foam (made by E. I. du Pont de Nemours and Company of Wilmington, Del.). Outsole 118 provides a ground engaging surface designed for traction and support and is typically made of an abrasive resistant material, such as tough rubber, for wear resistance. An alternate embodiment may have only an outsole made of a flexible durable foam material with substantial wear resistance. Yet another embodiment may have upper 112 glued or bonded to a thermoformed plastic plate which incorporates an outsole of flexible, durable foam material.

Although FIG. 1 shows a separate midsole 116 and outsole 118, it will be understood that any sole may be used in conjunction with the present invention without straying from the spirit of the invention. FIG. 1 also depicts sole 114 with windows 120 for exposing an insert 122. Insert 122 can aid midsole 116 in providing increased cushioning of the sole through one or more chambers containing air or gas. A description of the technology used to form insert 122 can be found in U.S. Pat. No. 5,771,606 to Litchfield et al., the disclosure of which is incorporated herein by reference. Again many different sole configurations can be used in conjunction with the invention.

Upper 112 includes a vamp 136 and an inner member 124. Inner member 124 may be formed of any conventional upper material such as leather. Alternatively, it can be formed from a woven or non-woven fabric such as neoprene. In a preferred embodiment of the invention, the inner member 124 conforms substantially to the shape of the foot and is made primarily of a stretchable material, such as LYCRA® material or another spandex fiber. LYCRA® is a trademark of the E. I. du Pont de Nemours and Company of Wilmington, Del. for its brand of elastane fiber. Inner member 124 may also include other types of fibers to achieve desired characteristics. Accordingly, the woven material of inner member 124 may be comprised of solely spandex or LYCRA® material, or combinations of spandex and/or LYCRA® material, and other materials such as nylon and/or cotton.

Inner member 124 may have attached thereto foxing 126. Foxing 126 is designed to prevent excessive wear in the toe region of the shoe. Typically, foxing 126 is made of a wear resistant material such as leather.

In the heel region of upper 112 is a heel counter which is attached to inner member 124. A heel counter cover 128 may be used to cover a conventional heel counter. As with many shoes, a heel counter wraps around the heel region and may be bonded, stitched, glued, etc. to the heel portion of upper 112. A heel counter provides even further support for the wearer's heel during athletic activities. The heel counter can be made of plastic, leather, paper, rubber or any other material capable of providing heel support.

Upper 112 also includes an outer member 134 extending around the exterior of inner member 124. Outer member 134 provides support and stability to inner member 124. In addition, outer member 134 serves as a low profile closure mechanism. Outer member 134 is comprised of a hook and pile closure material, such as is manufactured by Velcro USA Inc. The hook and pile closure material is described in detail below.

Figure 2:
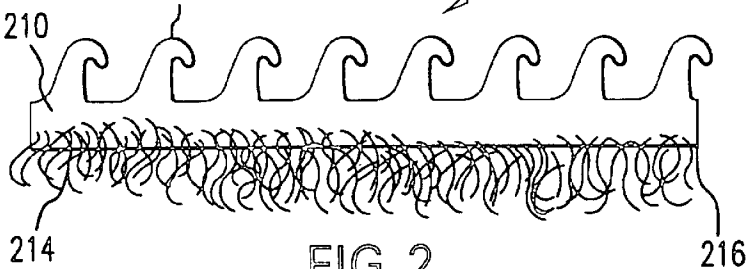
FIG. 2 is a cross-sectional schematic of a hook and pile material for use with the closure system of the present invention.

FIG. 2 shows a schematical cross-section of a material used for outer member 134. Outer member 134 comprises a material 200 which consists of a base 210 with hooks 212 projecting from base 210 and pile 214 attached to base 210. At an interface 216 between the two layers, the plastic from the base entraps some of the fibers of pile 214 bonding pile 214 to form a laminate of pile 214 and base 210 with interface 216 formed by the fibers interpenetrating and co-mingling with the solidified plastic resin. In a preferred embodiment of the present invention, hooks 212 are comprised of "Nylon 12" and pile 214 is comprised of nylon. One such material is made by Velcro USA, Inc., under the registered trademark ONE-WRAP. Also, in a preferred embodiment, the hooks and pile have a life-span of at least 80,000 cycles before breaking down. As would be apparent to one skilled in the relevant art, many different materials could be used to manufacture material 200 of the present invention. A more complete description of the product and the technology used to form material 200 can be found in U.S. Pat. No. 5,518,795 to Kennedy et al., the disclosure of with is incorporated herein by reference.

It should be noted that the ONE-WRAP® material made by Velcro USA, Inc. is sold for general use as a wrap tie to hold bundled items together. For example, the material has been used to bundle vegetables (such as individual stalks of asparagus) at a grocery store and to hold computer wires bunched together while storing and transporting computer accessories in a computer case.

Returning to FIG. 1, outer member 134 is the exterior portion of upper 112. Either the hook or pile can be the exterior surface of outer member 134. Additionally, outer member 134 serves as the closure system of the shoe. Because outer member 134 is comprised of a single ply hook and pile material, overlapping any one side of the material over the other side will cause the two overlapping pieces to attach. As shown, outer member 134 extends from sole 114 up the sides of shoe 110.

Outer member 134 includes vamp straps 138 and heel strap 140. Vamp straps 138 extend over vamp 136 and heel strap 140 extends around the heel region including heel counter cover 128. Vamp straps can extend from the medial side of the shoe to the lateral, or from the lateral side to the medial, or both, as is depicted in FIG. 1. Specifically, it is vamp straps 138 and heel strap 140 that enable outer member 134 to serve as the shoe closure system. For instance, each of vamp straps 138 and heel strap 140 is comprised of the hook and pile material described with reference to FIG. 2. Accordingly, each of straps 138 include either hooks or pile material on the exterior or exposed surface of straps 138, along with the entire outer member 134. Thus, the interior or non-exposed surface is comprised of the other of the hook or pile material. As straps 138 extend and overlap any portion of the exterior of outer member 134, the hooks and the pile material of the interior of straps 138 and the exterior of outer member 134 will attach, with the hooks embedding in and attaching to the pile material.

In use, the shoe can be closed by pulling straps 138 to a desired tautness. When the desired tautness is attained, the interior surface of the straps 138 can be caused to meet the exterior surface of outer member 134. The hooks and pile material will mesh in a locking engagement. By using such a hook and pile fastening assembly, the tautness of the straps can be easily adjusted. Furthermore, heel strap 140 can also be adjusted to a desired tautness to provide customized support and stability to the heel and ankle region.

Vamp straps 138 independently connect to outer member 134 to allow a wearer of the shoe to customize the closure system for optimal comfort and fit. A wearer can adjust the tightness of the shoe to attain a desired fit. Additionally, because the outer member of the upper 134 is comprised of the hook and pile material, a wearer can customize the closure system by adjusting the point of attachment, thereby allowing every shoe wearer to wear the strap across the vamp of the shoe at a different location, to customize the fit and conform the upper to any foot condition or shape. Thus, the closure system is not area-specific, but allows a wearer to position and attach the closure straps where they are most comfortable for the individual wearer.

The present invention also provides a low profile closure system. Use of the material 200 for both the strap and the upper securely closes the shoe with the thickness of only the strap and the upper and eliminates the need for gluing or sewing a hook material and a pile material to the profile of an already thick strap and/or upper of a shoe. Therefore, even when the closure system is securely closed, there is not a buildup of layered material at the attachment point. Thus, the shoe is rendered more comfortable and its appearance more elegant.

Heel strap 140 extends around the rear of shoe 10, and is comprised of the same material as outer member 134. Heel strap 140 consists of two straps which each extend from a respective side of the shoe, overlapping and engagebly locking by the hook and pile material. As such, either of the the two straps of heel strap 140 could be the exterior most strap when the strap is properly secured. Heel strap 140 can be manually engagably locked and unlocked to provide a desired level of tightness and support, enabling a wearer of shoe 110 to enjoy a custom fit.

As seen in FIG. 1, shoe 10 includes two vamp straps 138. However, as would be apparent to one skilled in the relevant art, vamp straps 138 could be one, three, four or even more straps. Furthermore, as would be apparent to one skilled in the relevant art, the closure system of the present invention could operate without heel strap 140. Likewise, heel strap 140 could be one or more straps extending around the heel and/or could include an ankle strap, as would be apparent to one skilled in the art.

Outer member 134 could cover the outer surface of the entire shoe 110, or, as shown in FIG. 1, may cover only a portion of the shoe, with the critical characteristic being that the shoe can be custom tightened by allowing the wearer to adust the strapping to accomplish tightening as well as being able to adjust and manipulate the attachment location to provide the utmost comfort.

Each of vamp straps 138 and heel strap 140 includes a grip 142 that extends along the end of the straps. Grip 142 could be a ridge that extends along the end region of the straps, and allows a wearer to comfortably pull a strap to tighten the shoe. Grip 142 could be a ridge, a grommet, a hole or any other element that could provide the above mentioned advantages. Additionally, grip 142 could be a rigid end covering the end of the straps, such as a plastic or rubber liner. As an alternative embodiment, the vamp strap 138 may contain no grip on the ends because the material is easily manipulated by hand.

As shown in FIG. 1, outer member 134 is attached to inner member 124 through stitching 144. Stitching 144 holds outer member 134 securely to the shoe, providing stabilization and support. Additionally, outer member 134 extends down to the bottom of sole 114 near the arch region, shown at 146, and optionally extends across sole 114 to the opposing side. Outer member 134 can be glued, bonded or sewn to the sole in arch region 146, as would be apparent to one skilled in the relevant art.

In another embodiment, outer member 134 is removably attached to sole 114 and/or inner member 124. A hook and pile fastener tab (not shown) extends from sole 114 in the area of stitching 144. Outer member 134 can be positioned around sole 114 and inner member 124, with a stirrup style fit in arch region 146. Outer member 134 is removably attached to the hook and pile fastener tab. Outer member 134 then performs substantially as described above, securely supporting and stabilizing the wearers foot in the shoe. This allows a wearer to customize shoe 110 by exchanging outer member 134 for a new or different outer member having a particular design, style or color. Likewise, it would be obvious to one skilled in the art that other ways exist for removably securing outer member 134 to sole 114 and/or inner member 124.

Figure 3:
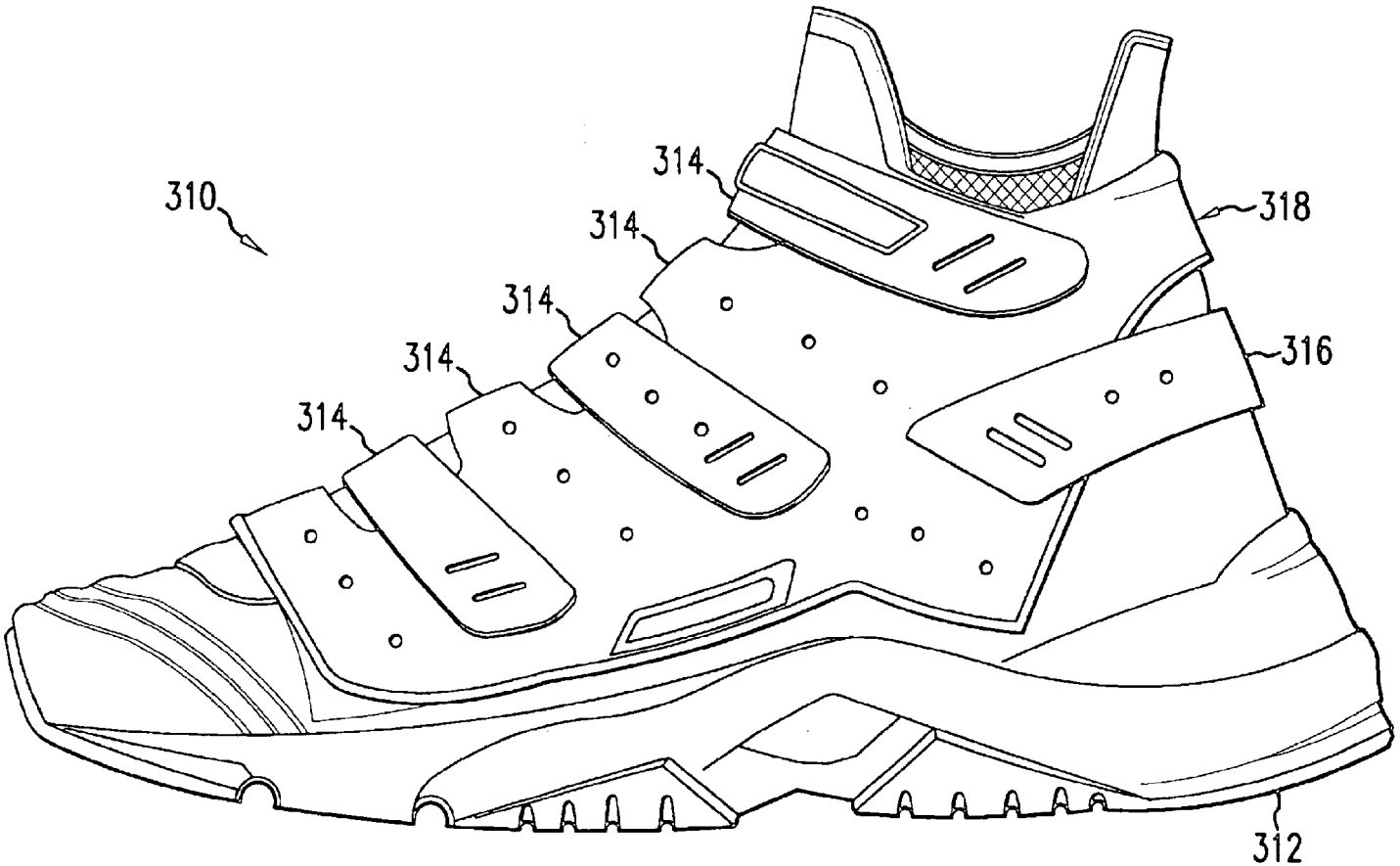
FIG. 3 is a second embodiment of a shoe, displaying the closure system the current invention.

FIG. 3 shows an alternate embodiment of a shoe 310 with another embodiment of the closure system of the present invention. Shoe 310 includes an outer member 312. Outer member 312 includes a total of five vamp straps 314 extending across the vamp region and a heel strap 316 extending around the rear of shoe 310. Outer member 312 is comprised of the same hook and pile material as described above with reference to FIG. 1. As such, a wearer can customize placement and attachment of vamp straps 314 and heel strap 316 to outer member 312 for maximum comfort, as described above with regard to FIG. 1. Outer member 312 also includes a support strap 318 which extends around the upper portion of the shoe, supporting the ankle area of the wearer. Support strap 318 can extend all the way around the upper of shoe as part of the uppermost vamp strap 318. Or, support strap 318 could be a non-adjustable support strap extending around the rear of the shoe from one side of the shoe to the other, as would be apparent to one skilled in the relevant art.

Figure 4A:
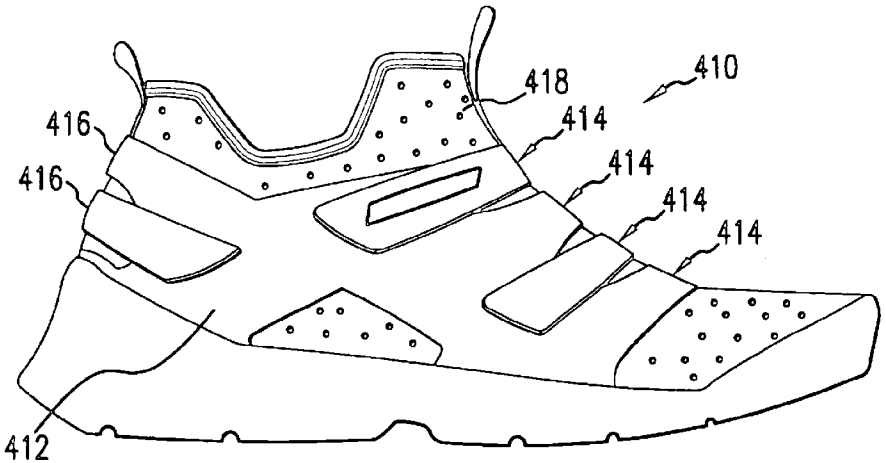
FIGS. 4A and 4B show a third embodiment of a shoe, displaying the closure system of the present invention.
Figure 4B:
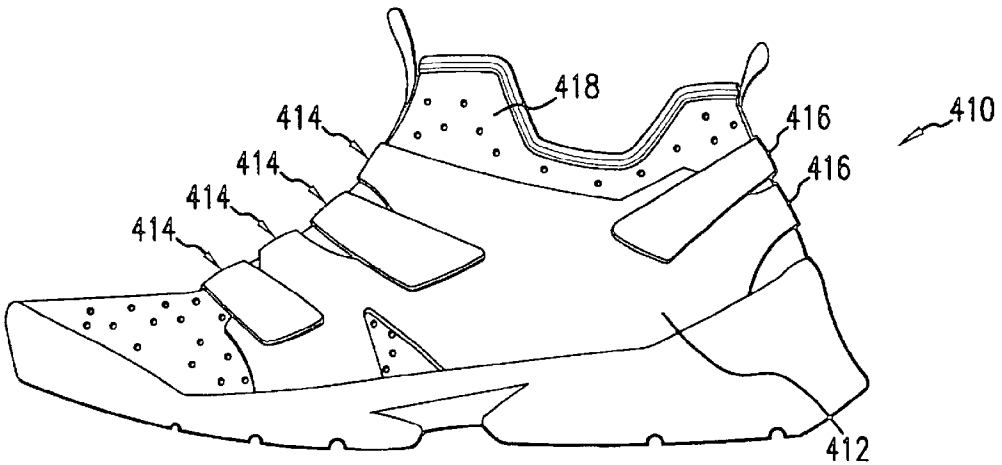

FIGS. 4A and 4B show another embodiment of a shoe 410 using the closure system of the present invention. Shoe 410 includes an outer member 412 and an inner member 418. Outer member 412 is comprised of the same material as described above with reference to FIG. 1. In this embodiment, outer member 412 includes two heel straps 416 that extend around the rear portion of shoe 410. Additionally, four vamp straps 414 are used to securely support and allow low-profile customization of the closure system.

Figure 5:
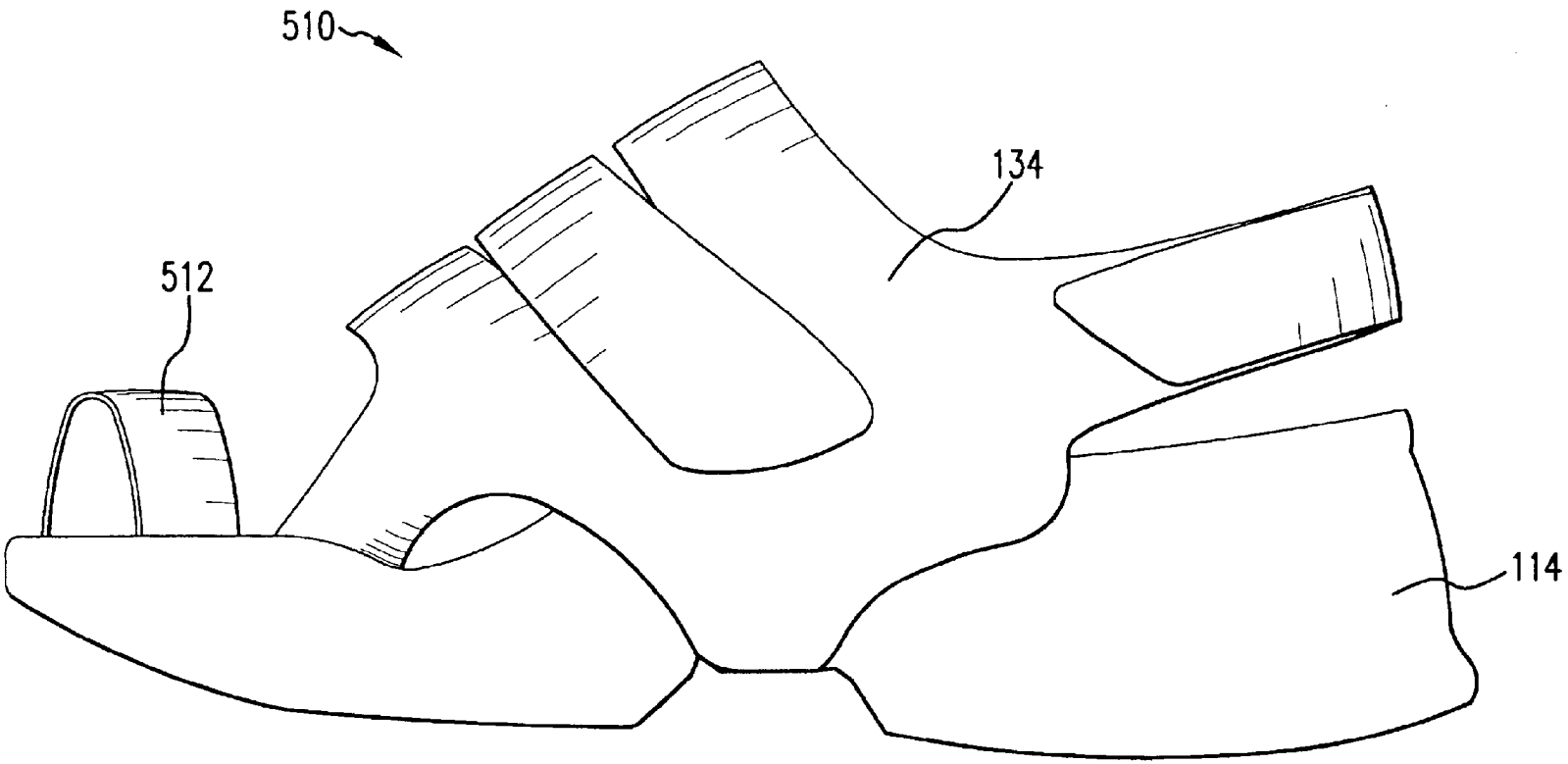
FIG. 5 is a sandal using the closure system of the present invention.

In the embodiment of FIG. 5, the closure system of the present invention is used independent of an inner member as an upper for a sandal type shoe 510. In this embodiment, outer member 134 is connected to sole 114. This embodiment also includes a toe strap 512. Toe strap 512 could be designed to fit over the large toe of the wearer, or extend over all the toes of the wearer, as would be apparent to one skilled in the relevant art. Toe strap 510 could be made of the hook and loop material of outer member 134, allowing customizing adjustment, or could be another material as would be apparent to one skilled in the relevant art. Likewise, sandal 510 could be used without toe strap 512, relying only on outer member 134 to bind the foot to sandal 510.

In any of the above described embodiments, removable design elements or patches may be used in conjunction with the upper to enable a wearer to design his or her own shoe. Because materials having a hook and pile construction (i.e. hook on one side of the material and pile on the other) are used to form part or all of the upper, a wearer could place decorative elements or patches on the exterior of the upper. If the exterior of the upper has pile on the outside, then the element would have hooks, thereby enabling the element to attach to the exterior of the upper. Likewise, if the exterior of the upper has hooks on the outside, then the element would have pile, thereby enabling the element to attach to the exterior of the upper.

With regard to apparel, the present invention combines the material described above, made by Velcro USA, Inc. to form a closure system for jackets, shirts, pants, including pant waists, or cuffs of any article of apparel, including jackets, shirts and pants. The closure system provides a wearer with the ability to customize the fitting of the apparel, including the tightness of the apparel around an individual.

Figure 6:
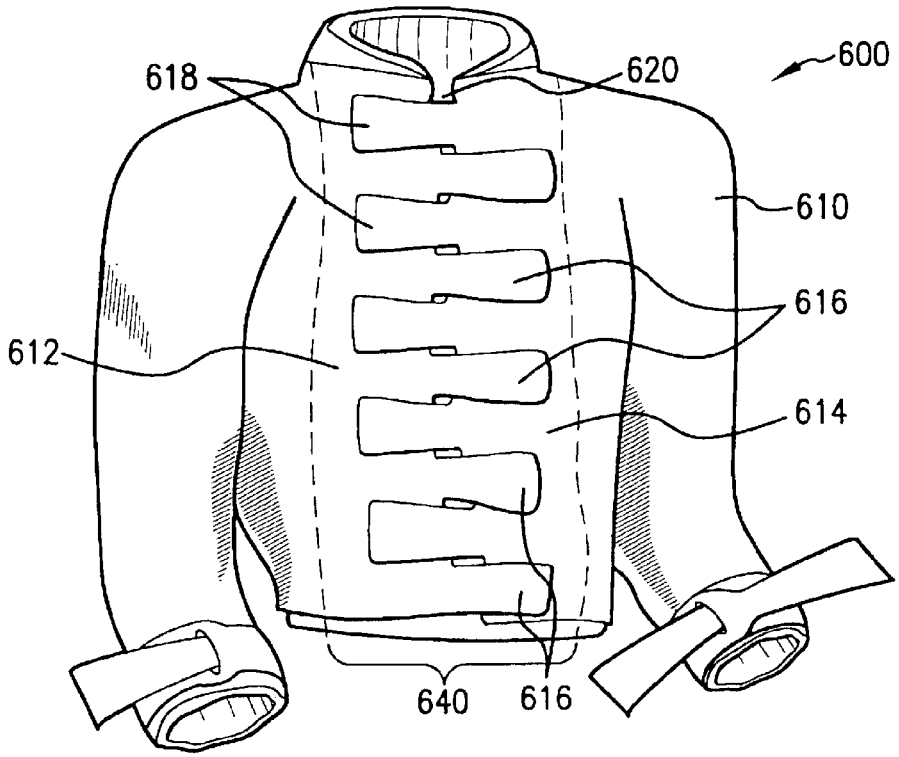
FIG. 6 is a jacket using the closure system of the present invention.

FIG. 6 depicts a jacket 600 utilizing the closure system of the present invention. Jacket 600 includes an outer surface 610 comprising a front chest portion 640, as shown in FIG. 6 by the dotted lines, having a right flap 612 and a left flap 614. Right flap 612 and left flap 614 are separated by a split 620. Right flap 612 and left flap 614 are the portions of the front of jacket 600 that open along split 620 to receive a person, and close to cover the front of a person when jacket 600 is worn.

In one embodiment, substantially all of outer surface 610 is comprised of material 200, described with reference to FIG. 2, having hooks on one side and pile on the other side of a single-ply material. Thus, substantially the entire exterior surface of jacket 600 is comprised of either hooks or pile. Jacket 600 could have an inner lining in the sleeves, in the body area, or both.

In another embodiment, the hook or pile material comprises only the front chest portion 640. In this embodiment, the hook or pile material extends down the front of jacket 600 from about the neck line to the jacket waist. The remaining area of outer surface 610 could be any conventional jacket material.

The closure system of the invention could be implemented using either a laminated hook and pile material or a single-ply hook and pile material, such as material 200. Either the hook material or the pile material could be the exterior surface of outer surface with the other being the interior surface. Overlapping any one side of the material over the other side will cause the overlapped piece, or the exterior surface to attach to the underlapped piece, or the interior surface.

Extending from right flap 612 are a plurality of right straps 616. Right straps 616 are lengths of hook or pile material connecting at one end to right flap 612, and extending across slit 620 of the jacket to fasten to left flap 614. Because the interior surface of right straps 616 contacts the exterior surface of left flap 614, the hooks or pile, depending on which is the interior surface, of right strap 616 engage and fasten to the hooks or pile of left flap 614. Likewise, extending from left flap 614 are left straps 618. Left straps 618 are positioned such that they extend across slit 620 of the jacket to fasten to right flap 612. Preferably, right straps 616 and left straps 618 are integral with, and formed from the same cut of material 200 as right flap 612 and left flap 614. However, right straps 616 and left straps 618 could be sewn, glued, or otherwise attached to right flap 612 and left flap 614, respectively, as would be apparent to one skilled in the relevant art.

In a preferred embodiment, right straps 616 and left straps 618 comprise material 200. Each of right straps 616 and left straps 618 is comprised of the single-ply hook and pile material described with reference to FIG. 2. Accordingly, each of right straps 616 and left straps 618 include either hooks or pile material on their exterior or exposed surface, as well as right flap 612 and left flap 614. Thus, the interior or non-exposed surface of the straps is comprised of the other of the hook or pile material. As right and left straps 616, 618 extend and overlap any portion of the exterior of right or left flaps 612, 614, the hooks and the pile material of the interior of right and left straps 616, 618 and the exterior of right and left flaps 612, 614 will attach, with the hooks embedding in and attaching to the pile material.

In the embodiment shown in FIG. 6, right straps 616 and left straps 618 are arranged on right flap 612 and left flap 614 such that they alternate along slit 620 when the jacket is in a "fastened" position. Accordingly, when putting on the jacket, a wearer would begin at the top or bottom and alternatingly attach the right and left straps 616, 618 to the respective opposing right or left flap 612, 614. One advantage of the invention is that a wearer can adjust the jacket to provide a custom fit by pulling right and left straps 616, 618 to a desired tautness, thereby adjusting the tightness of the jacket around the wearer's body. When the desired tautness is attained, the interior surface of right and left straps 616, 618 can be caused to meet the exterior surface of right or left flap 612, 614. The hooks and the pile material will mesh in a locking engagement. By using such a hook and pile fastening assembly, the tautness of the straps can be easily adjusted to provide a custom fit. Additionally, a wearer can customize the closure system by adjusting the point of attachment in two dimensions, both vertically and horizontally, thereby allowing every wearer to wear the right and left straps 616, 618 at a different location, to customize the fit and conform the jacket to any desired condition or shape. Thus, the closure system is not area-specific, but allows a wearer to position and attach the straps where they are most comfortable for the individual wearer.

Figure 7:
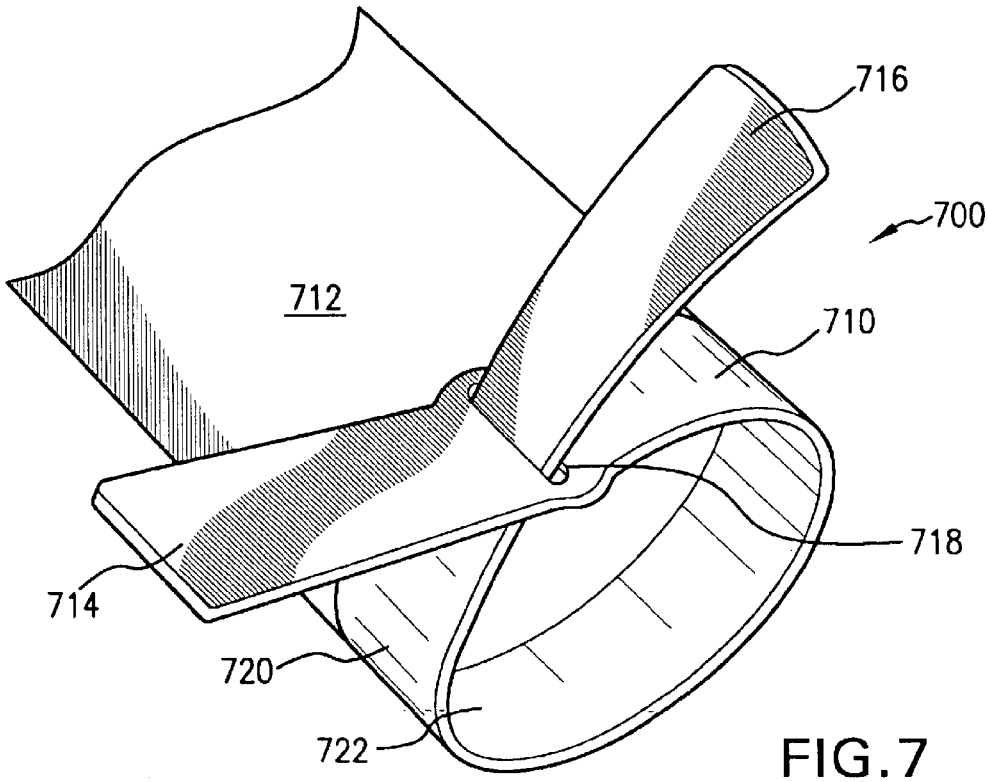
FIG. 7 is a cuff of a jacket using the closure system of the present invention.

FIG. 7 is an embodiment of a cuff 700 of a jacket implementing the closure system of the present invention. Cuff 700 could be on jacket 600 or any other jacket. Likewise, cuff 700 could be the cuff of a shirt or could, alternatively, be the waistline of a pair of pants, shorts or a skirt or any other article of clothing that may be tightened for fitting. Cuff 700 includes a strap 710 that extends completely around the cuff opening. In some apparel, because the circumference of the cuff may be large, the strap material need not extend completely around the opening, but can be supplemented with other material. Strap 710 is preferably comprised of the single-ply hook and pile material described with reference to FIG. 2. However, strap 710 could be a laminated material, as would be apparent to one skilled in the relevant art. Strap 710 is sewn or otherwise attached to sleeve 712 along a portion of the length of strap 710. Strap 710 has a primary portion 714 and a secondary portion 716. Primary portion 714 includes a slot 718 through which secondary portion 716 extends. The size of the cuff opening is adjustable by pulling secondary portion 716 through slot 718. Slot 718 may have the same width as strap 710, with sides that bulge outward and extend beyond the width of strap 710 in the region of slot 718, as is shown in FIG. 7. In one embodiment, secondary portion 716 is more narrow than primary portion 714, and thus easily fits through slot 718 when slot 718 has a smaller width than that of primary portion 714. Slot 718 may include a plastic or metal liner extending around the circumference of the slot, through which secondary portion 716 may pass through to avoid direct rubbing by secondary portion 716 against primary portion 714 at the edge of the slot.

Strap 710 includes an exterior surface 720 and an interior surface 722 with hooks on one surface and pile on the other surface. Although either the hooks or the pile could be on the exterior surface 720, cuff 700 is described as if the pile is on the exterior surface 720 and the hooks are on the interior surface 722. Accordingly, as primary or secondary portion 714, 716 extend and overlap any portion of exterior surface 720, the hooks of interior surface 722, which includes the underside of primary and secondary portions 714, 716, engage and attach to the pile on exterior surface 720. Thus, in use, when primary or secondary portions 716, 718 are caused to contact any other portion of strap 710, the hooks and pile engage, fastening the diameter of cuff 700 in place.

To adjust the diameter of the cuff opening, the hooks of primary and secondary portions 714, 716 of strap 710 are both disengaged from the exterior surface 720. Both primary portion 714 and secondary portion 716 are then simultaneously tightened by pulling the ends, and secondary portion 716 is drawn through slot 718 until the cuff is sized to a desired diameter. Finally, primary portion 714 and secondary portion 716 are fastened against the exterior surface 720 of strap 710 by causing the pile of the interior surface of primary portion 714 and secondary portion 716 to contact and engage the pile of the exterior portion.

One advantage of using a single-ply material such as material 200 as the hook and pile material at the cuff of a jacket is that it is no longer necessary to sew or glue separate strips of hook and pile fasteners to the cuff of the jacket to have an adjustable cuff. The single-ply cuff is itself the hook and pile fastener material.

In one embodiment, the system of cuff 700 could be used to adjust the tightness of a pair of pants around a wearer's waist. In this embodiment, the strap extends only partially around the waist in the belt area, and is sewn to pant material. Thus, the strap is actually at least two straps, each having one end sewn or otherwise adhered to the pants in the belt area. As is shown in FIG. 7, a secondary portion, or a first strap extends through a slot in a primary portion, or second strap. The pants can be drawn tighter around the waist by disengaging the hook or pile material on the primary or secondary portion, and pulling the ends of the primary and the secondary portion so that the secondary portion slides through the slot of the primary portion. Finally, the primary and secondary portions can be reattached to the exterior portion of the strap by contacting the interior surface of the primary and secondary portions to the exterior surface of the strap, thereby engaging the hooks and pile of the fastener. In another embodiment, the strap could extend completely around the wearer's waist, as would be apparent to one skilled in the relevant art. It is also apparent that the apparel tightening system could be used on shorts or skirts or any article of clothing that is fit around a wearer's body.

While the invention has been particularly shown and described with reference to preferred embodiments thereof, it will be understood by those skilled in the art that various changes in form and detail may be made therein without departing from the spirit and scope of the invention.

What is claimed is:

1. Footwear, comprising:

a sole;

an upper attached to said sole wherein a portion of said upper is formed of a material having a first side and a second side wherein said first side has a pile and said second side has hooks opposite substantially everywhere said first side has pile, wherein said portion extends from a throat region of said upper to a region of said upper that attaches to said sole.

2. The footwear of claim 1, further comprising at least one strap formed of said material extending from at least one of a medial side and lateral side of said upper, wherein said at least one strap is capable of being removably fastened to said portion of said upper located on the other of said medial side and said lateral side.

3. The footwear of claim 2, wherein said at least one strap extends from and is formed as a unitary structure with said portion of said upper.

4. The footwear of claim 2, wherein at least two straps extend from said portion of said upper with a first strap extending from said medial side and a second strap extending from said lateral side.

5. The footwear of claim 2, further comprising at least one heel strap of said material extending from said portion of said upper on at least one of said medial and lateral sides, wherein said at least one heel strap extends behind the heel of a wearer and is capable of being removably fastened to said portion of said upper of said footwear located on the other of said medial and lateral sides.

6. The footwear of claim 2, wherein a first heel strap of said material extending from said portion of one of said medial and lateral sides is capable of being removably fastened behind the heel of a wearer of said footwear to a second heel strap of said material extending from said portion of the other of said medial and lateral sides.

7. The footwear of claim 1, wherein said material is a single-ply material.

8. The footwear of claim 1, wherein said portion includes at least 50% of said upper.

9. Footwear comprising:

a sole, an upper attached to said sole, said upper including a vamp having a medial side and lateral side and at least one vamp strap, wherein at least a portion of one of said medial and said lateral sides of said vamp extending from a throat region of said upper to a region of said upper that attaches to said sole and a portion of said at least one vamp strap are formed from a material with a first side and a second side, said first side having a plurality of hooks and said second side having a pile, wherein said at least one vamp strap extends from at least one of said medial side and lateral side of said upper and removably fastens to said portion of said vamp located on the other of said medial side and said lateral side of said upper.

10. The footwear of claim 9, wherein said at least one vamp strap is formed as a unitary structure with said portion on said side from which said at least one vamp strap extends.

11. The footwear of claim 9, wherein at least two vamp straps extend from said upper with at least one vamp strap extending from said medial side and one vamp strap extending from said lateral side.

12. The footwear of claim 9, said upper further comprising a heel region including at least one heel strap extending from said heel region on at least one of said medial and lateral sides, wherein said heel region and said at least one heel strap are formed from a material with a first side and a second side, said first side having a plurality of hooks and said second side having a pile and wherein said heel strap extends behind the heel of a wearer and is removably fastened to said heel region on the other of said medial and lateral sides.

13. The footwear of claim 12, wherein said at least one heel strap is removably fastened behind the heel of a wearer of said footwear to at least another heel strap extending from the other of said medial and lateral sides.

14. The footwear of claim 9, wherein said material is a single-ply material.

15. The footwear of claim 9, wherein said portion includes at least 50% of said upper.

16. Footwear, comprising:

a sole;

an upper attached to said sole wherein a portion of said upper is formed of a material having a first side and a second side wherein said first side of said material includes a plurality of hooks and said second side of said material includes a pile;

wherein said portion includes a region extending from said sole through a throat region of said upper, wherein said hook and said pile are coextensive on a single-ply of said material.

17. The footwear of claim 16, wherein said portion includes at least 50% of said upper.

* * * * *